United States Patent [19]

Hill et al.

[11] 3,973,586

[45] Aug. 10, 1976

[54] VELOCITY-TUBING PRESSURE ACTUATED SUBSURFACE SAFETY VALVE

[75] Inventors: Tom H. Hill, Pensacola, Fla.; Martin E. True, Houston, Tex.

[73] Assignee: Exxon Production Research Company, Houston, Tex.

[22] Filed: Apr. 16, 1975

[21] Appl. No.: 568,766

[52] U.S. Cl. ..... 137/460; 166/224 A

[51] Int. Cl.[2] ..... E21B 43/00

[58] Field of Search ..... 137/460, 501, 504, 498; 166/224 A

[56] References Cited

UNITED STATES PATENTS

| | | | |
|---|---|---|---|
| 3,070,119 | 12/1962 | Raulins | 137/460 |
| 3,090,443 | 5/1963 | Bostock | 166/224 A |
| 3,265,134 | 8/1966 | Tausch | 137/460 X |
| 3,603,394 | 9/1971 | Raulins | 137/460 X |
| 3,794,112 | 2/1974 | Hill | 166/224 A X |

*Primary Examiner*—Henry T. Klinksiek
*Attorney, Agent, or Firm*—John S. Schneider

[57] ABSTRACT

A subsurface safety valve which is used to control the flow of well fluids through well tubings combines (1) the velocity valve principle of differential pressure and (2) a change in well tubing pressure to produce a closing force for the valve. A valve housing is connected into a well production tubing. A movable valve element is connected to the valve housing. In one position of the valve element flow of fluids through the valve housing is permitted and in another position thereof flow of fluids through the valve housing is prevented. The movable valve element forms with the valve housing a pressure chamber and larger and smaller differential areas. An inwardly protruding surface or flow bean is formed on the valve element. Fluids flowing through the valve housing cause a pressure differential across the flow bean. The flow bean is located between the larger and smaller differential pressure areas, the larger being above and the smaller below the flow bean. The flow bean is sized relative to the sizes of the differential pressure areas in any particular flow system so that the differential pressure across the flow bean is below that required to overcome the tubing pressure forces holding the valve open under normal flow velocity conditions. However, the valve closes upon increased flow velocity above normal flow velocity because of the increased differential pressure across the flow bean and decreased tubing pressure on the larger differential pressure area.

10 Claims, 6 Drawing Figures

VELOCITY-TUBING PRESSURE ACTUATED SUBSURFACE SAFETY VALVE

BACKGROUND OF THE INVENTION

The present invention concerns a subsurface safety valve for controlling the flow of well fluids, particularly oil and/or gas fluids produced from subsurface formations.

The valve of this invention does not require the additional tubings or pipes which are required to supply fluid from the surface in hydraulic surface controlled safety valve systems and thereby overcomes the inherent disadvantages of such safety valve systems. Also, this valve provides an improvement over safety valves which are operated solely by velocity and safety valves which are operated solely by changes in absolute tubing pressures. It combines the differential pressure feature of the velocity valve and the feature of change in the absolute tubing pressure. By employing different piston areas this valve eliminates springs and spacers used in velocity-type valves. It also eliminates pre-charged chambers used in pressure actuated valves.

SUMMARY OF THE INVENTION

A subsurface safety valve for use in closing off flow of well fluids through well tubing which comprises a valve housing; a movable valve element connected to the housing and having one position in which flow of fluids through the housing is permitted and another position in which flow of fluids through the housing is prevented; said movable valve element and housing cooperating to form a pressure chamber and larger and smaller differential pressure areas; an enlarged inner surface (flow bean), arranged on the valve element in the flow path of the fluids flowing through said housing; said larger pressure area being located above said flow bean and said smaller pressure area being located below said flow bean; said flow bean being sized relative to the sizes of said differential pressure areas in any particular flow system so that the differential pressure across the flow bean is below that required to overcome the tubing pressure forces holding the valve open under normal flow velocity conditions, said valve closing upon increased flow velocity above normal flow velocity because of the increased differential pressure across said flow bean and decreased tubing pressure on said larger differential pressure area.

DETAILED DESCRIPTION OF THE INVENTION

Figure 1:
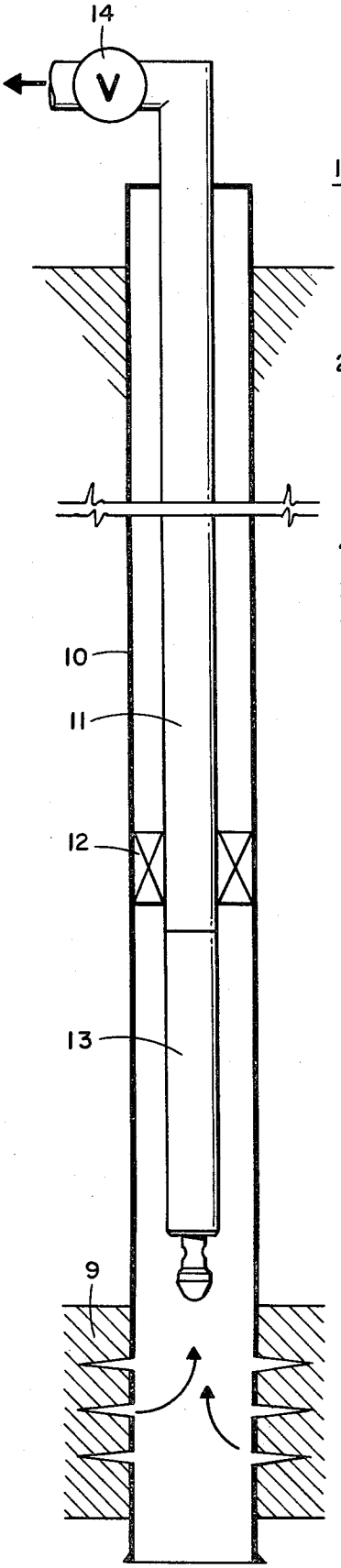
FIG. 1 illustrates a subsurface safety valve, in accordance with the invention, connected to a well tubing suspended in a well casing.

There is shown in FIG. 1 a well casing 10 in which a well pipe or tubing string 11 is suspended. A packer 12 closes the annulus between the casing and the tubing string. The directional flow of well fluids from a subsurface formation 9 is indicated by the arrowed lines. A subsurface safety valve 13 is connected to the lower end of tubing 11 below packer 12. A valve 14 is connected into tubing 11 at the surface.

Figure 2:
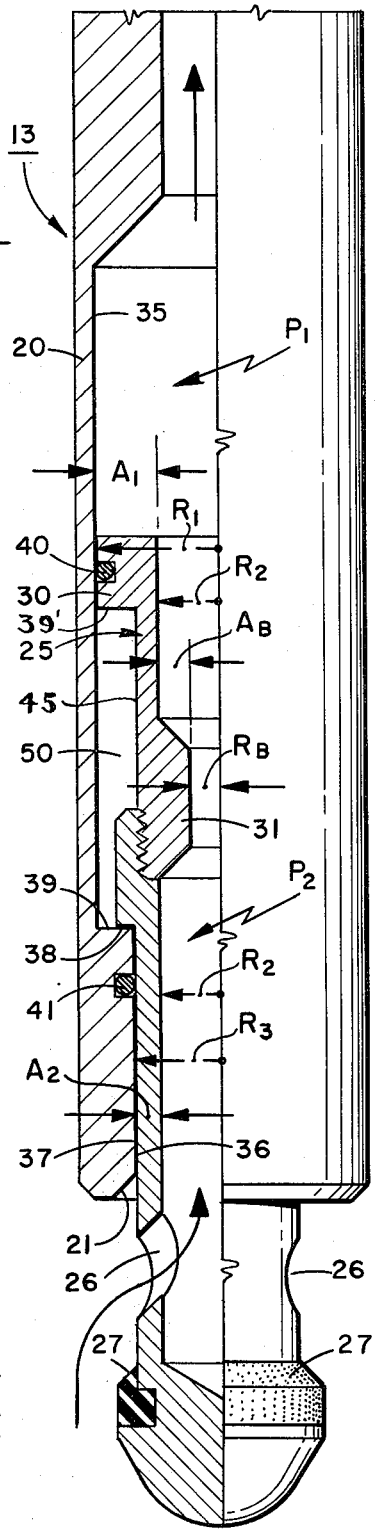
FIG. 2 shows the safety valve of FIG. 1 in greater detail in open position.
Figure 3:
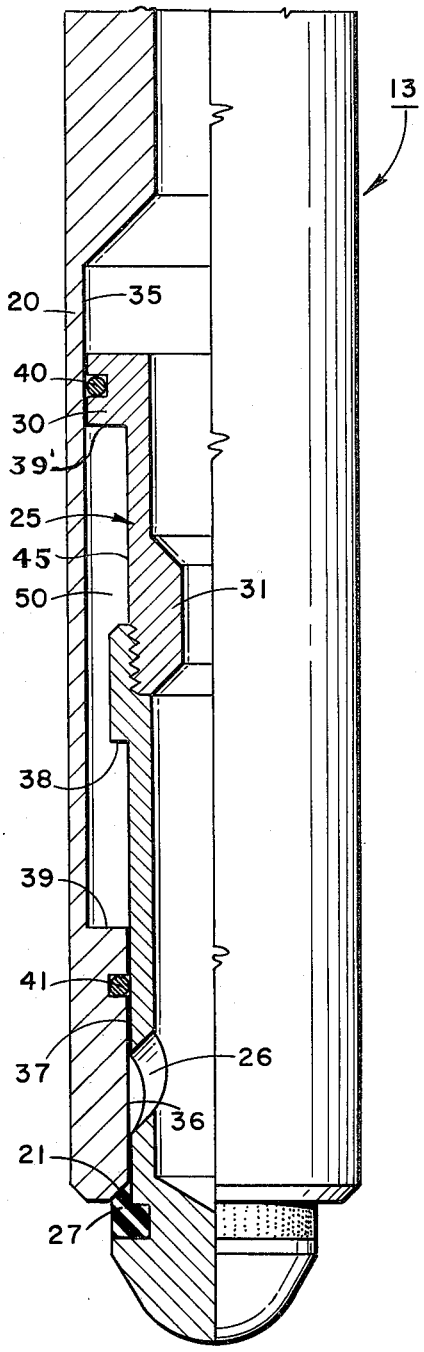
FIG. 3 shows the safety valve of FIG. 1 in greater detail in closed position.

In FIGS. 2 and 3 details of valve 13 are shown. A valve housing 20 contains a valve closure means, valve seat 21. A flow tube 25 is slidably or movably arranged within valve housing 20. Flow tube 25 has a top cross-sectional area $A_1$ and a bottom sealing sectional cross-section area $A_2$. The lower end of flow tube 25 contains openings 26 and a valve closure means, valve seating surface 27. In the valve's closed position, as seen in FIG. 3, surface 27 engages valve seat 21 and openings 26 in the flow tube are located within housing 20. Flow tube 25 is provided with an outwardly extending shoulder piston member 30 and an enlarged inner surface or flow bean 31 of a selected radius $R_B$ and cross-sectional area, $A_B$. The upper inner wall 35 of housing 20 has a radius $R_1$ substantially the same as the radius of the outer surface of shoulder piston 30 of flow tube 25. The inner wall of flow tube 25 has a radius $R_2$ above and below flow bean 31. The lower inner wall 36 of housing 20 has a radius $R_3$ substantially the same as the radius of the outer wall 37 of flow tube 25. An O-ring seal 40 seals off the space between piston shoulder 30 and inner wall 35 of housing 20 and an O-ring seal 41 seals off the outer wall 37 of flow tube 25 and the inner wall 37 of valve housing 20. An additional shoulder 38 formed on flow tube 25 is engageable with shoulder 39 formed on the inner wall of housing 20 to form a lower stop for flow tube 25. The inner wall 35 of housing 20, the outer wall 45 of flow tube 25 and shoulders 39 and 39' form an expansible, contractible chamber 50 which is at atmospheric pressure in the closed position of the safety valve shown in FIG. 3. $P_1$ designates the pressure downstream of bean 31 (psi) and $P_2$ designates the pressure upstream of bean 31 (psi).

The relative cross-sectional areas defined by flow tube 25 at seals 40 and 41 and the flow bean size are selected and designed for the particular flow system in which they are to be used. Such design determines the tubing pressure force on piston shoulder 30 needed to maintain the valve open.

In operation, as valve 13 is lowered into casing 10 well pressure acts on top of piston shoulder 30 and forces flow tube 25 downwardly to the open position shown in FIG. 2. After the valve has been landed the well is opened to flow thus creating differential pressure across bean 31. This differential pressure creates a force attempting to move flow tube 25 upwardly to close the valve, the position of the valve shown in FIG. 3. Bean 31, however, is sized to limit the differential pressure across the bean to below that required to overcome the pressure force on shoulder piston 30 holding the valve open during normal flow. However, when uncontrolled flow occurs two factors cooperate to move flow tube 25 upwardly to close the valve: (1) increased differential pressure force across flow bean 31 and (2) as a result of such increased differential pressure, less tubing pressure force on shoulder piston 30 holding the valve open.

An example of the operation of the valve follows. A typically sized safety valve for 2⅞ inch production tubing might have the following dimensions:

$A_1 = 2.365$ in.$^2$; $A_2 = 1.22$ in.$^2$; $A_B = 0.59$ in.$^2$ $A_1 + A_B = 2.995$ in.$^2$; $A_2 + A_B = 1.81$ in.$^2$ $R_1 = 1.0$ in.; $R_2 = 0.5$ in.; $R_3 = 0.8$ in.; $R_B = 0.25$ in.

Opening force $(F_O) = P_1$ (lb./in.$^2$) $\times A_1 + A_B$ (in.$^2$) = 2.995 $P_1$ (lbs.)

Closing force $(F_C) = P_2$ (lbs./in.$^2$) $\times A_2 + A_B$ (in.$^2$) = 1.81 $P_2$ (lbs.)

Net force $= F_O - F_C$ (lbs.)

For normal flowing operation, the following conditions may be considered typical:

Flow Rate = 200 barrels per day B/D $P_1 = 400$ psi; $P_2 = 600$ psi.

Then the net force $= F_O - F_C = 400\ (2.995) - 600\ (1.81) = 112$ lbs. (valve open)

Assume that the well flows out of control and that the following conditions exist:

Flow Rate = 282 barrels per day B/D $P_1 = 118$ psi; $P_2 = 400$ psi.

Then the net force $= F_O - F_C = 118\ (2.995) - 400\ (1.81) = -371$ lbs. (valve closes)

Figure 4:
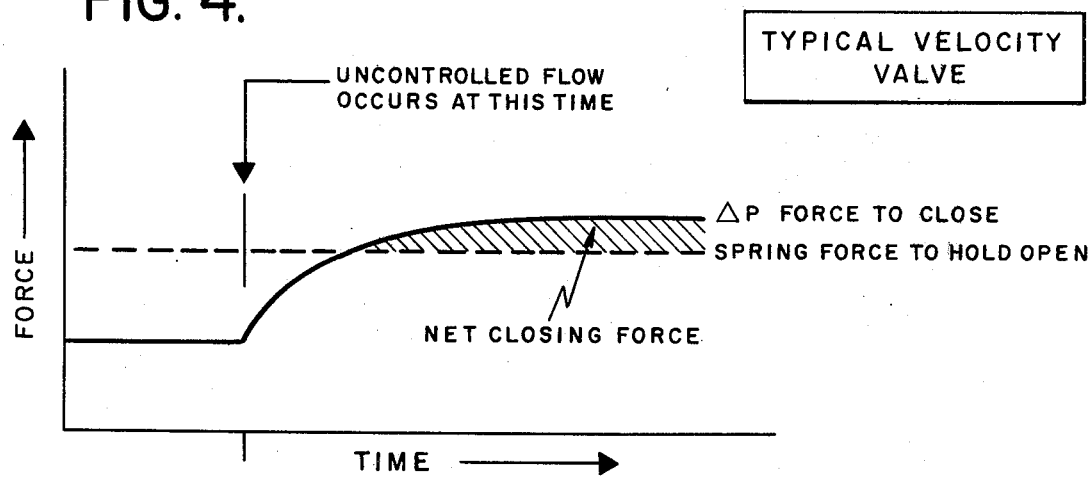
FIG. 4 is a plot of force versus time depicting graphically a typical velocity valve operation in which the velocity valve has a constant opening force created by a spring.
Figure 5:
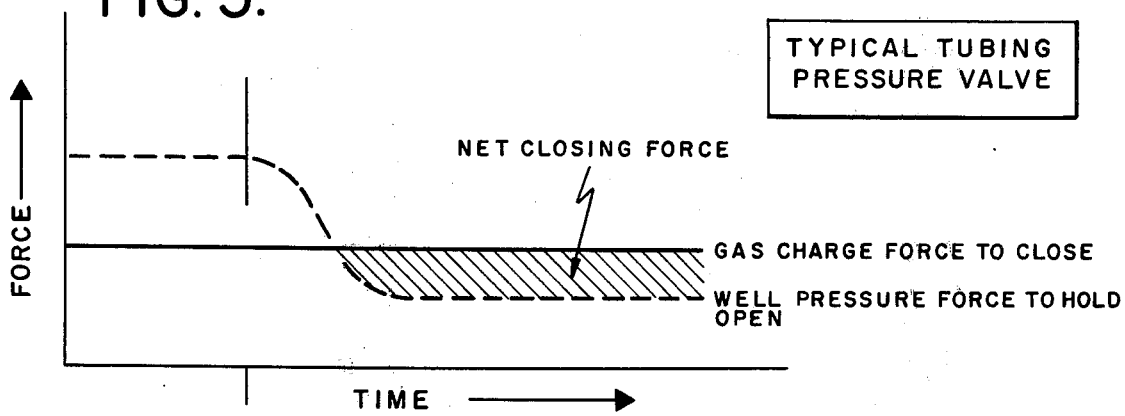
FIG. 5 is a plot of force versus time graphically illustrating the operation of a tubing pressure sensitive valve which is held open by tubing pressure and closed by an internal gas charge when tubing pressure drops as the result of uncontrolled flow.
Figure 6:
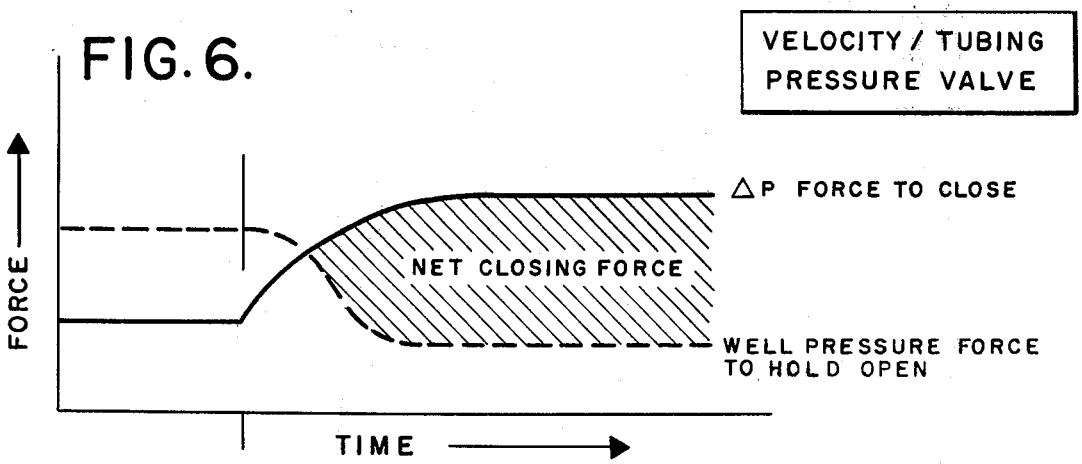
FIG. 6 is a plot of force versus time illustrating graphically the operation of the valve of the invention.

FIGS. 4, 5 and 6 compare the operation of the valve of the present invention with two subsurface control valves in present use. In FIG. 4 operation of a typical velocity valve is depicted. Such valve has a constant opening force created by a spring and as flow increases to maximum the differential pressure force across a flow bean eventually exceeds the spring force and closes the valve. In FIG. 5 operation of a tubing pressure sensitive valve is illustrated. That valve is held open by tubing pressure and is closed by an internal gas charge when tubing pressure drops due to uncontrolled flow. The net closing forces are approximately the same for each of the valves of FIGS. 4 and 5. In FIG. 6 operation of the valve of the invention is depicted. A higher net closing force gained through the combined use of tubing pressure and differential pressure forces is attained.

The present valve, in addition, has the added advantage of being "fail-safe" in the event of O-ring seal leaks since tubing pressure in chamber 50 eliminates the force applied to piston shoulder 30 holding the valve open and the differential pressure across flow bean 31 closes the valve immediately.

Changes and modifications, such as for example reversing the valve seat and valve seating surface, may be made in the illustrative embodiments of the invention shown and described herein without departing from the scope of the invention as defined in the appended claims.

Having fully described the nature, objects, apparatus, operation and advantages of our invention we claim:

1. A subsurface safety valve for use in automatically closing off the flow of producing well fluids through well tubing comprising:

a valve housing;

a movable valve element connected to said valve housing and having one position which permits flow of fluids through said valve housing and another position which prevents flow of fluids through said valve housing;

said movable valve element and said valve housing forming an expansible-contractible chamber and larger and smaller differential areas;

an enlarged inner surface or flow bean arranged on said valve element causing a pressure differential across said flow bean when fluids flow through said valve housing;

said larger pressure area being above said flow bean and said smaller area being below said flow bean; and said flow bean being sized relative to said differential areas in any particular flow system so that the differential across said flow bean is below that required to overcome the pressure forces holding the valve open under normal flow velocity conditions, said valve closing upon increased flow velocity above normal flow velocity because of the increased differential pressure across said flow bean and decreased tubing pressure on said larger differential pressure area.

2. A subsurface safety valve as recited in claim 1 in which said movable valve element comprises a flow tube, said flow tube cooperating with said valve housing to form said chamber and said larger and smaller differential pressure areas; and sealing means for sealing off fluid flow to and from said chamber.

3. A subsurface safety valve as recited in claim 2 including first valve closure means arranged on an end of said valve housing; and second valve closure means positioned on an end of said flow tube, said flow tube having an opening there-in above said second valve closure means, said well fluids being prevented from flowing through said opening and said valve housing when said first and second valve closure means are engaged.

4. A subsurface safety valve as recited in claim 3 in which said first valve closure means comprises a valve seat and said second valve closure means comprises a valve seating surface.

5. A subsurface safety valve as recited in claim 3 in which said first valve closure means comprises a valve seating surface and said second valve closure means comprises a valve seat.

6. A subsurface safety valve for use in closing off flow of well fluids through well tubing comprising:

a valve housing;

a shoulder formed on the inner wall of said valve housing to provide increased and decreased inner wall radii;

first valve closure means arranged on said valve housing;

a flow tube movable in said valve housing and having substantially the same outer radius as the decreased inner wall radius of said valve housing and having an outwardly extending shoulder having substantially the same radius as the increased inner wall radius of said valve housing to form a chamber and upper larger and lower smaller pressure areas;

a flow bean formed on said flow tube, said well fluids flowing through said housing causing a pressure differential across said flow bean;

second valve closure means arranged on said flow tube;

said flow tube having an opening therein, said well fluids flowing through said opening and said housing when said first and second valve closure means are disengaged;

said well fluids being prevented from flowing through said opening and said valve housing when said first and second valve closure means are engaged;

first sealing means arranged between said outwardly extending shoulder on said flow tube and the increased radius inner wall of said valve housing; and second sealing means arranged between the outer wall of said flow tube and the decreased radius inner wall of said valve housing.

7. A subsurface safety valve as recited in claim 6 including:

stop means formed on the outer wall of said flow tube engageable with said shoulder formed on the inner wall of said valve housing.

8. A subsurface safety valve as recited in claim 7 in which said first valve closure means comprises a valve seat and said second valve closure means comprises a valve seating surface.

9. A subsurface safety valve for use in closing off flow of well fluids through well tubing comprising:

a valve housing;

a shoulder formed on the inner wall of said valve housing to provide increased and decreased inner wall radii;

first valve closure means arranged on said valve housing;

a flow tube movable in said valve housing and having substantially the same outer radius as the decreased inner wall radius of said valve housing and having an outwardly extending shoulder having substantially the same radius as the increased inner wall radius of said valve housing; said flow tube having a flow bean formed on said flow tube; an opening, second valve closure means arranged on said flow tube for closing off flow of fluids through said opening when engaged with said first valve closure means; said well fluids flowing through said opening when said first and second valve closure means are disengaged;

first sealing means arranged between said outwardly extending shoulder on said flow tube and the increased inner wall radius of said valve housing; and second sealing means arranged between the outer wall of said flow tube and the decreased inner wall radius of said valve housing.

10. A subsurface safety valve for use in automatically closing off the flow of producing well fluids through well tubing comprising:

a valve housing;

a movable valve element connected to said valve housing and having one position which permits flow of fluids through said housing and another position which prevents flow of fluids through said housing;

a flow bean arranged on said valve element causing a pressure differential across said flow bean when well fluids flow through said valve housing;

said valve housing and said valve element forming larger and smaller differential pressure areas within said housing, said larger differential pressure area being above said flow bean and said smaller differential pressure area being below said flow bean; and said flow bean being sized relative to said differential pressure areas so that the differential pressure across the bean is below that required to overcome the pressure forces holding the valve open under selected flow velocity conditions, said valve closing upon increased flow velocity above said selected flow velocity because of increased differential pressure across said flow bean and decreased tubing pressure on said larger differential pressure area.

* * * * *